US012673395B2

(12) United States Patent
Wendt

(10) Patent No.: US 12,673,395 B2
(45) Date of Patent: Jul. 7, 2026

(54) CONDITIONING OF A SUPERABRASIVE GRINDING TOOL

(71) Applicant: Reishauer AG, Wallisellen (CH)

(72) Inventor: Lars Wendt, Scherzingen (CH)

(73) Assignee: REISHAUER AG, Wallisellen (CH)

( * ) Notice: Subject to any disclaimer, the term of this patent is extended or adjusted under 35 U.S.C. 154(b) by 430 days.

(21) Appl. No.: 18/035,872

(22) PCT Filed: Dec. 7, 2021

(86) PCT No.: PCT/EP2021/084598
§ 371 (c)(1),
(2) Date: May 8, 2023

(87) PCT Pub. No.: WO2022/128630
PCT Pub. Date: Jun. 23, 2022

(65) Prior Publication Data

US 2023/0415305 A1 Dec. 28, 2023

(30) Foreign Application Priority Data

Dec. 15, 2020 (CH) ..... 1589/20

(51) Int. Cl.
*B24B 53/06* (2006.01)
*B24B 53/047* (2006.01)

(52) U.S. Cl.
CPC ..... *B24B 53/062* (2013.01); *B24B 53/047* (2013.01)

(58) Field of Classification Search
CPC . B23F 23/1225; B24B 53/085; B24B 53/083; B24B 53/12; B24B 53/14; B24B 53/06; B24B 53/07; B24B 53/062
(Continued)

(56) References Cited

U.S. PATENT DOCUMENTS 5,209,020 A * 5/1993 Feisel ..... B23F 23/1231 451/21
5,857,894 A 1/1999 Griesbach et al.
(Continued)

FOREIGN PATENT DOCUMENTS

CN 110851921 A 2/2020
DE 10 2014 111 317 A1 2/2016
(Continued)

OTHER PUBLICATIONS

International Search Report for PCT/EP2021/084598 dated Mar. 14, 2022.
(Continued)

*Primary Examiner* — Robert F Neibaur
(74) *Attorney, Agent, or Firm* — Sughrue Mion, PLLC

(57) ABSTRACT

In a method of machining workpieces in a gear grinding machine with a grinding tool having vitrified-bonded abrasive grains made of a superabrasive material. The grinding tool is first dressed. Subsequently, the dressed grinding tool is conditioned such that a desired wear condition is produced. Thereafter, pre-toothed workpieces are machined using the dressed and conditioned grinding tool. Conditioning prevents undesirable grinding-in behavior of the grinding tool, which can cause thermal damage to the edge zone of the workpiece. Conditioning is performed with a conditioning kinematics, which is different from the machining kinematics and may correspond to a dressing kinematics. For conditioning, a conditioning tool is used which has a basic shape that is different from the basic shape of the workpieces.

20 Claims, 3 Drawing Sheets

(58) Field of Classification Search
USPC ..... 451/47, 147, 443, 253, 900, 161, 275; 125/11.01, 11.03, 11.04; 409/63
See application file for complete search history.

(56) References Cited

U.S. PATENT DOCUMENTS

| | | | | |
|---|---|---|---|---|
| 6,012,972 | A | 1/2000 | Jankowski | |
| 6,234,880 | B1 | 5/2001 | Scacchi | |
| 7,121,930 | B2 * | 10/2006 | Thyssen | B24B 53/075 451/5 |
| 10,610,941 | B2 * | 4/2020 | Yanase | B23F 9/02 |
| 2005/0272349 | A1 | 12/2005 | Burgess | |
| 2017/0312838 | A1 * | 11/2017 | Mueller | B23F 1/023 |

FOREIGN PATENT DOCUMENTS

| | | | |
|---|---|---|---|
| DE | 10 2018 109 067 | A1 | 10/2019 |
| JP | 5-220663 | A | 8/1993 |
| JP | 5-269665 | A | 10/1993 |
| JP | 7-9339 | A | 1/1995 |
| JP | 10-76424 | A | 3/1998 |
| JP | 2009-50922 | A | 3/2009 |
| JP | 2010-17789 | A | 1/2010 |
| JP | 2012-51084 | A | 3/2012 |
| JP | 2020-15129 | A | 1/2020 |

OTHER PUBLICATIONS

Dr. Thomas Bergs, et al., "Potentials of gear grinding with ceramic bonded cBN", Research Report FVA 778 I, IGF No. 18580 N (6 pages).
"Ceramic bonded cBN", FVA No. 778, FVA Booklet No. 1375, Jun. 30, 2020, Research Project No. 778 I, Issue 1375 (211 pages).
Mathias Kirchgatter, "Application behavior of grooved CBN grinding wheels with ceramic bond during external cylindrical plunge-cut grinding", Dissertation, Traffic and Machine Systems of the Technical University of Berlin, 2010 (342 pages).
Jens Holger Muckli, "High speed grinding with ceramic bonded CBN grinding wheels", Dissertation, RWTH Aachen University, 2000, vol. 31 (351 pages).
Dirk Stuff, "Single-soot preparation of ceramic-bonded CBN grinding wheels", Dissertation, RWTH Aachen University, Progress reports VDI Series 2: Production Engineering, No. d2 P, 1997 (264 pages).
Markus White, "Influence of the specification of multilayer CBN grinding tools on the grinding process behavior", Dissertation, RWTH Aachen University, 2016, vol. 26, 1st Edition (24 pages).
English Translation of Office Action issued Aug. 22, 2025 in Taiwanese Application No. 110143212.
Translation of Korean Office Action dated Mar. 3, 2026, issued in Application No. 10-2023-7020940.
Translation of Chinese Office Action dated Dec. 24, 2025, issued in Application No. 202180083986.1.

* cited by examiner

CONDITIONING OF A SUPERABRASIVE GRINDING TOOL

CROSS REFERENCE TO RELATED APPLICATIONS

This application is a National Stage of International Application No. PCT/EP2021/084598 filed Dec. 7, 2021, claiming priority based on Swiss Patent Application No. 01589/20 filed Dec. 15, 2020.

TECHNICAL FIELD

The present invention relates to a method for machining workpieces in a gear grinding machine with a grinding tool which is configured as a profile grinding wheel or grinding worm and has vitrified-bonded abrasive grains made of a superabrasive material, in particular cBN, and to a gear grinding machine which is designed to carry out the method.

PRIOR ART

In gear grinding, a choice can be made between different specifications for the grinding tool. In addition to dressable corundum tools with vitrified bond and non-dressable cBN tools with electroplated bond, dressable cBN tools with vitrified bond are also known. Vitrified-bonded cBN tools exhibit increased flexibility over electroplated bonded tools due to the dressable bond. Due to the high performance cBN cutting grain, vitrified-bonded cBN tools can achieve high material removal rates. As a result, the machined volume between two dressing operations can be increased compared to corundum tools.

A disadvantage of vitrified-bonded cBN tools is that an undesirable grinding-in behavior occurs (Research Report FVA 778 I, IGF No. 18580 N, retrieved on 16.11.2020 from www.fva-net.de). The term "grinding-in behavior" is understood to designate the phenomenon that thermal damage to the edge zone of heat-treated workpieces (so-called grinding burn) can occur immediately after dressing when using a vitrified-bonded cBN tool. For example, during discontinuous profile grinding of gears, where individual gear gaps are ground sequentially, thermal damage to the edge zone is often documented in the first machined gear gaps after dressing. There are various approaches to explaining this grinding-in behavior (insufficient chip space, exposed bond, flattening of the cBN grains).

To overcome this problem, the prior art proposed to condition the grinding tool after dressing by "breaking-in" the grinding tool. Two strategies have been proposed for this. According to a first strategy, after dressing, the first gear gaps or the first workpieces are machined with reduced infeed and/or reduced axial feed rate. This strategy is costly to implement and can result in the properties of the initially machined workpieces deviating from the properties of workpieces machined later. According to a second strategy, after dressing, one or several sacrificial workpieces are machined first and then discarded. This strategy is time-consuming and cost-intensive.

US2005272349A1 discloses a method of conditioning a superabrasive grinding tool in which, after dressing the grinding tool, a plurality of cuts are made in a sacrificial element. The geometry of the sacrificial element corresponds to the geometry of the workpieces subsequently machined with the grinding tool.

SUMMARY OF THE INVENTION

It is an object of the present invention to disclose a method which, when using grinding tools with vitrified-bonded superabrasive abrasive grains, ensures uniform workpiece machining without causing thermal damage to the edge zone of the workpieces at the beginning of the tool life and without the need to machine sacrificial workpieces.

Thus, a method is proposed for machining workpieces in a gear grinding machine with a grinding tool comprising vitrified-bonded abrasive grains made of a superabrasive material, in particular cBN. The method comprises the steps:

a) dressing the grinding tool;

b) conditioning the dressed grinding tool such that a desired wear condition of the grinding tool is produced, wherein the gear grinding machine executes a conditioning kinematics; and c) machining pre-toothed workpieces with a predetermined basic shape using the dressed and conditioned grinding tool, wherein the gear grinding machine executes a machining kinematics.

The process is characterized in that the conditioning kinematics is different from the machining kinematics.

In contrast to the prior art, a sacrificial workpiece is thus not machined with the machining kinematics for conditioning, but conditioning is performed with a conditioning tool that is moved relative to the grinding tool with a special conditioning kinematics. In particular, the conditioning kinematics may correspond to a dressing kinematics such as may be used for dressing the grinding tool. Accordingly, a conditioning tool having a different basic shape than a workpiece, in particular having the basic shape of a dressing tool, may be used for conditioning. For example, if the workpieces are gear-shaped, the conditioning tool is preferably not also gear-shaped. Instead, the conditioning tool may be, for example, a rotating, disc-shaped conditioning tool or a stationary, for example, pin- or tooth-shaped conditioning tool.

Using a different kinematics for conditioning than the machining kinematics results in various advantages. In particular, conditioning can be performed in a much more targeted manner, since the motion sequences can be specifically adapted to achieve an optimum conditioning result. For example, technological parameters such as the infeed of the conditioning tool radially to the axis of rotation of the grinding tool, the rotational speeds of the grinding tool and, if applicable, of the conditioning tool, the direction of action (up-cut or down-cut direction) and, if conditioning is not performed in line contact along the complete working profile of the grinding tool, the contouring feed rate and the degree of overlap can be specifically adjusted. The use of a conditioning tool with separate conditioning kinematics can also reduce unproductive idle time that would otherwise occur after conditioning for replacing a sacrificial workpiece with a workpiece to be machined. Also, unlike a sacrificial workpiece, the conditioning tool can be used multiple times. This significantly reduces material consumption.

The following definitions are used in this document.

In the present document, a "superabrasive material" is understood to be a material whose Vickers microhardness at room temperature is higher than the microhardness of corundum. The class of superabrasive materials includes, in particular, cubic boron nitride (cBN) and diamond. For hard finishing of pre-toothed steel workpieces, cBN is particularly significant because, unlike diamond, it has no chemical affinity for typical gear materials. In this respect, the present invention relates in a particular way to grinding tools whose abrasive body is formed by vitrified-bonded cBN grains.

"Thermal edge zone damage" of a workpiece or "grinding burn" is defined as a damage pattern as specified in ISO 14104:2017-04. The verification of whether or not there is thermal edge zone damage is performed by the surface temper etching method defined in ISO 14104:2017-04. Thermal damage to the edge zone of a workpiece as defined in the present document is present if, according to ISO 14104:2017-04, the workpiece does not meet classification FA/NB2 after a type 3 etching.

In the present document, the term "basic shape" means the geometric shape of an object, abstracted from minor differences in dimensions. For example, two cylindrical gears with the same helix angle, the same module and the same number of teeth are considered to be objects with the same basic shape, even if, for example, the tooth thickness, the profile shape or the flank line of the cylindrical gears differ. Conversely, a disk without cylindrical gear teeth or a fixed pin, tooth or rod are considered to be objects that have a different basic shape than a cylindrical gear.

In the present document, the term "dressing" or "truing" is understood to mean a process by which, on the one hand, a desired geometric shape of a grinding tool is produced or restored and, on the other hand, the grinding tool is sharpened by bringing the rotating grinding tool into engagement with a dressing tool.

In the present document, the term "conditioning" is understood to mean the specific bringing about of a desired wear condition. During conditioning, the geometric shape of the grinding tool, as produced during dressing, is preferably no longer changed. Conditioning can in particular serve to remove bonding agents between the abrasive grains after dressing in order to partially expose the abrasive grains.

The terms "dressing kinematics", "conditioning kinematics" and "machining kinematics" are respectively understood to mean the sequence of movements performed by the grinding machine during the process of "dressing", "conditioning" and "machining", respectively. In particular, a dressing kinematics is understood to be a sequence of movements in which a dressing tool is brought into engagement with the rotating grinding tool to dress the grinding tool. The dressing kinematics may include movements of the grinding tool relative to a machine bed of the grinding machine and/or movements of the dressing tool relative to the machine bed. The dressing kinematics are generated by one or more numerically controlled (NC) axes of the grinding machine. Accordingly, "conditioning kinematics" is understood to mean a sequence of movements in which a conditioning tool is brought into engagement with the rotating grinding tool to condition the grinding tool, and "machining kinematics" is understood to mean a sequence of movements in which the rotating grinding tool is brought into engagement with the workpiece to machine the workpiece.

Two kinematics are considered to be different if the associated movements not only differ in individual parameters such as movement length, speed, etc., but the basic sequence of movements is different. For example, the machining kinematics in continuous generating gear grinding with a grinding worm is different from a dressing kinematics in which the grinding worm is dressed with a rotating dressing wheel. For example, the machining kinematics in continuous generating gear grinding includes a forced coupling of the rotational speeds of the grinding worm and the workpiece to satisfy the rolling condition, while the dressing kinematics does not include such a forced coupling. Also, the machining kinematics in discontinuous profile grinding with a profile grinding wheel is fundamentally different from a dressing kinematics for dressing the profile grinding wheel with a rotating dressing wheel. For example, the machining kinematics requires that the profile grinding wheel be brought into engagement with the next tooth gap after machining one tooth gap. This element is completely missing in the dressing kinematics.

According to the invention, the conditioning kinematics differs from the machining kinematics, i.e. during conditioning a different sequence of movements is performed than the sequence of movements used for machining the workpieces. The conditioning tool is preferably clamped on a conditioning device which is different from the workpiece spindle, i.e., unlike when sacrificial workpieces are used, conditioning is not carried out with the aid of the workpiece spindle, but with the aid of a conditioning device which is separate therefrom. The conditioning device can in particular be integrated into a dressing device or combined with it.

In particular, the basic shape of the conditioning tool can correspond to the basic shape of the dressing tool that is specifically used for dressing the grinding tool, or, when several dressing tools are used, to the basic shape of one of these dressing tools. For example, if a rotary, disc-shaped dressing tool is used for dressing, the conditioning tool may also be disc-shaped and have similar dimensions to the dressing tool. The conditioning kinematics may then correspond to the dressing kinematics for this dressing tool.

However, the basic shape of the conditioning tool may also differ from the basic shape of the dressing tool actually used. For example, the dressing may be performed with a rotating, disc-shaped dressing tool, while the conditioning tool is designed as a stationary element, e.g. as a pin, tooth or rod. Accordingly, the conditioning kinematics may differ from the actual dressing kinematics used. Nevertheless, the conditioning kinematics in this case is also a kinematics such as could also be used for dressing, and in this respect the conditioning kinematics also corresponds to a dressing kinematics in this case.

Preferably, the conditioning tool is made of metal, in particular steel, in a region that comes into contact with the grinding tool during conditioning. Preferably, the steel is a steel with similar properties to the steel from which the workpieces are made. In particular, it may be the same type of steel as used for the workpieces. In particular, the conditioning tool may correspond to the base body, made of steel, of a dressing tool whose hard material coating has been omitted.

As already mentioned, in some embodiments, the conditioning tool is stationary during the conditioning process. In other embodiments, the conditioning tool rotates during the conditioning process, wherein this rotation may be in down-cut ("climb") or up-cut ("conventional") direction relative to the rotation of the grinding tool.

In the case of a rotating conditioning tool, the conditioning tool may have the basic shape of a dressing roll, i.e. a disc-shaped basic shape. In particular, the conditioning tool may have the shape of a so-called profile roll or a form roll. The term "profile roll" is to be understood to relate to a dressing roll that is configured to dress the grinding tool in line contact in such a way that a profile shape of the dressing roll is transferred to the grinding tool. The line contact may, for example, only take place in the area of one flank of the grinding tool, it can take place on two adjacent flanks, or it can also include intermediate head and/or foot areas of the grinding tool. On the other hand, the term "form roll" is to be understood as relating to a dressing roll that is provided to dress the grinding tool in point contact. As already explained, the conditioning tool preferably corresponds to the base body of a dressing roll made of steel without hard material coating.

Regardless of whether the conditioning tool is configured to be rotating or stationary, the conditioning tool may generally be in line contact with at least a portion of the working profile of the grinding tool during the conditioning process, or it may be in point contact with a portion of that working profile. Provided that the conditioning tool is not in line contact along the entire working profile of the grinding tool, it may be possible that the gear grinding machine performs a relative movement between the grinding tool and the conditioning tool such that the contact position between the conditioning tool and the grinding tool changes along the profile of the grinding tool during conditioning.

As already mentioned, the present invention allows all workpieces in step c) to be machined with identical machining parameters, in particular with identical infeed perpendicular to the workpiece spindle axis and identical axial feed rate along the workpiece spindle axis. These machining parameters can be selected such that thermal edge zone damage would occur during machining of at least a first workpiece in step c) if step b) were not performed. This is possible because in step b) the conditioning is carried out in such a way that during the machining in step c) precisely no more thermal edge zone damage occurs.

Steps a) to c) can be repeated several times. The conditioning process b) can be carried out several times with the same conditioning tool. Thus, unlike a sacrificial workpiece, the conditioning tool does not have to be discarded after a single conditioning process, but can be reused several times.

The workpiece machining in step c) may in particular be performed by continuous generating gear grinding or by discontinuous profile grinding. The grinding tool may accordingly be a grinding worm or a profile grinding wheel.

The present invention also provides a gear cutting machine particularly configured for carrying out the method disclosed above. The gear cutting machine comprises:

- a tool spindle on which a grinding tool can be clamped;
- at least one workpiece spindle on which a workpiece can be clamped;
- a dressing device on which a dressing tool can be clamped;
- a plurality of machine axes for driving the tool spindle, the workpiece spindle and the dresser and moving them relatively to each other; and
- a control unit for controlling the machine axes.

The gear cutting machine is characterized in that it comprises a conditioning device which is different from the workpiece spindle, wherein a conditioning tool can be clamped onto the conditioning device. The control unit is then configured to control the machine axes such that the machine tool performs a method of the type indicated above, such that the conditioning is performed with a conditioning kinematics which is different from the machining kinematics and which preferably corresponds to a dressing kinematics.

BRIEF DESCRIPTION OF THE DRAWINGS

Preferred embodiments of the invention are described in the following with reference to the drawings, which are for explanatory purposes only and are not to be construed in a limiting manner. In the drawings.

DESCRIPTION OF PREFERRED EMBODIMENTS

Design of an Exemplary Machine Tool

Figure 1:
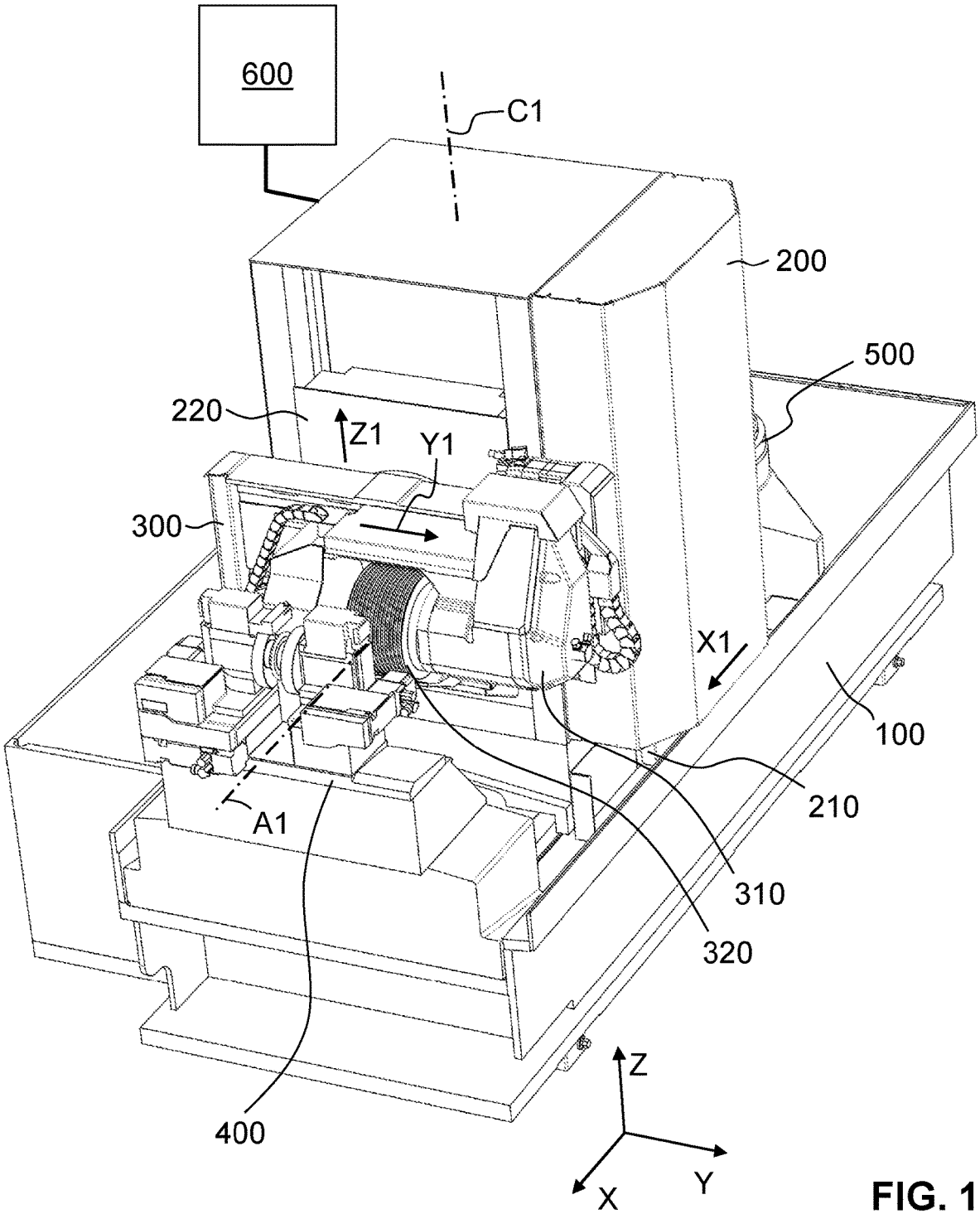
FIG. 1 shows a gear grinding machine according to an embodiment example in a perspective view.

FIG. 1 shows an example of a machine tool for hard finishing of gears by generating gear grinding. Horizontal spatial directions are denoted by X and Y, and the vertical spatial direction (direction of gravity) is denoted by Z. The machine has a machine bed 100 on which an infeed slide 210 is arranged to be movable along an infeed direction X1. The infeed direction X1 corresponds to the horizontal spatial direction X. A tower-like tool carrier 200 is mounted on the infeed slide 210 so as to be pivotable about a vertical pivot axis C1, hereinafter referred to as the C1 axis. A feed slide 220 is arranged on the tool carrier 200 so as to be movable along an axial feed direction Z1. The feed direction Z1 corresponds to the vertical spatial direction Z. The feed slide 220 carries a tool head 300 which is pivotable relative to the feed slide 220 about a horizontal pivot axis A1, hereinafter referred to as the A1-axis. The A1-axis is parallel to the infeed direction X1. A tool spindle 310 is arranged on the tool head 300 so as to be movable along a shift direction Y1. The shift direction Y1 is perpendicular to the A1-axis and at an angle to the axial feed direction Z1, which depends on the pivot angle of the tool head 300 about the A1 axis. A grinding tool 320 in the form of a grinding worm is clamped on the tool spindle 310 to rotate about a tool spindle axis 1 (see FIGS. 2 to 5). The tool spindle axis 1 is parallel to the shift direction Y1.

A dressing device 400 is arranged on the machine bed 100. On a side of the tool carrier 200 facing away from the dressing device 400, a workpiece spindle 500, which is only partially visible in FIG. 1, is arranged on the machine bed 100 to rotate a workpiece 510 clamped thereon about a vertical workpiece spindle axis C' (see FIGS. 4 and 5). The tool carrier 200 is pivotable 180° about the C1 axis between a machining position and a dressing position. In the machining position of the tool carrier 200, the grinding tool 320 can be brought into engagement with the workpiece 510 (see FIGS. 4 and 5). In the dressing position, the grinding tool 320 can be brought into engagement with dressing tools of the dressing device 400 described in more detail below (see FIGS. 2 and 3). In FIG. 1, the tool carrier 200 is shown in the dressing position.

A machine control 600, shown only symbolically, receives signals from sensors in the machine and controls the linear and pivot axes of the machine, the tool spindle, the workpiece spindle and the dressing device.

A machine concept according to FIG. 1 is disclosed in U.S. Pat. No. 5,857,894A. Corresponding machines are available under the designation RZ 400 from Reishauer A G, Wallisellen, Switzerland.

Dressing and Conditioning Device

Figure 2:
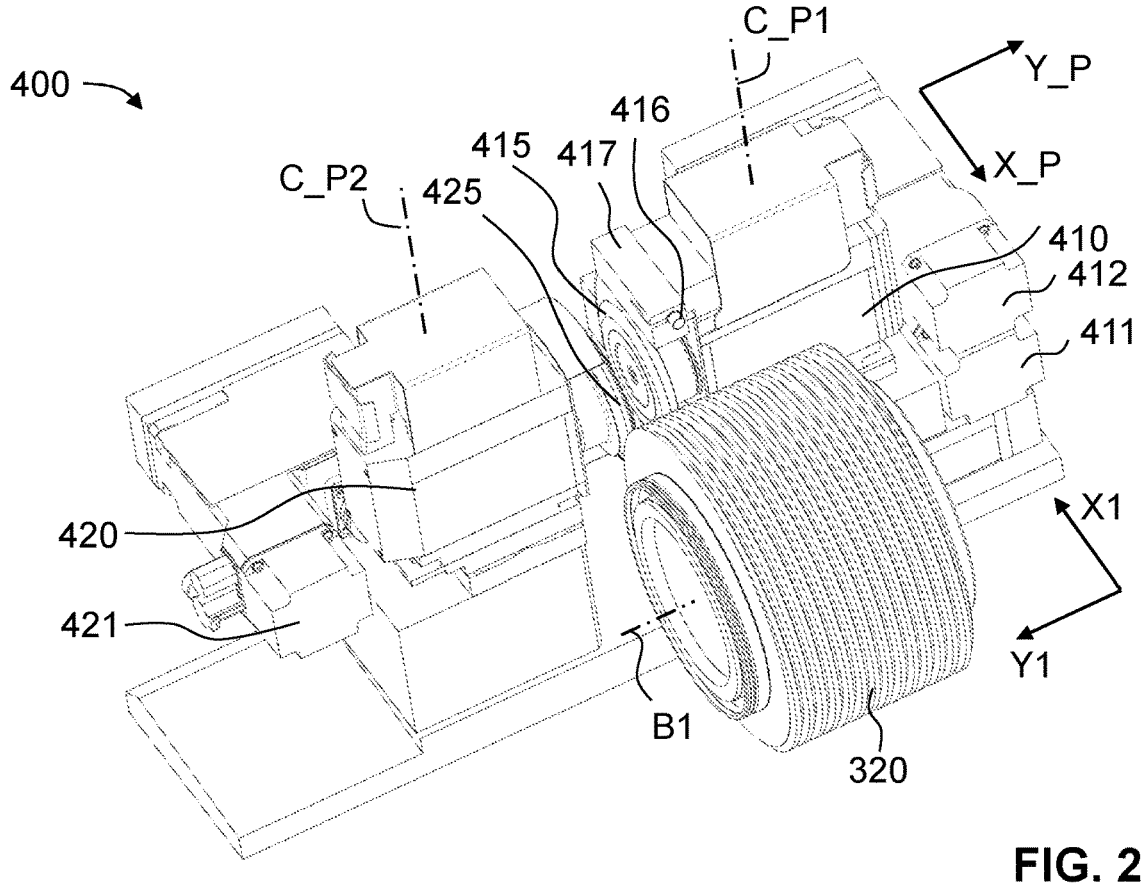
FIG. 2 shows a section of the gear grinding machine of FIG. 1 in the area of the dressing device, wherein parts of the gear grinding machine are not shown for simplification.

In FIG. 2, a section of the machine in FIG. 1 is illustrated from a different viewing direction. Parts of the machine have been omitted in order to achieve a clearer representation.

The grinding tool 320 is illustrated in FIG. 2 as being free-floating. However, it will be understood that the grinding tool is still clamped to the tool spindle 310 as illustrated in FIG. 1. For the discussion below, it is assumed that the grinding tool 320 comprises an abrasive body made of vitrified-bonded cBN.

In particular, FIG. 2 shows the structure of the dressing device 400. The dressing device 400 comprises a first dressing spindle 410 which is pivotable relative to the machine bed about a vertical axis C_P1 as well as linearly movable along two orthogonal horizontal directions X_P, Y_P. A pivot drive 411, a first linear drive 412 and a second linear drive, which is not visible in FIG. 2, serve this purpose. A disk-shaped dressing tool 415 is clamped on the first dressing spindle 410 for rotation. The dressing device 400 further comprises a second dressing spindle 420, which is pivotable relative to the machine bed about a vertical axis C_P2 by means of a pivot drive 421. A second disk-shaped dressing tool can be clamped on the second dressing spindle 420 for rotation.

In the context of the present invention, a disk-shaped first conditioning tool 425 is clamped on the second dressing spindle 420 in lieu of a dressing tool. Additionally or alternatively, a stationary second conditioning tool 416 may be provided. The stationary conditioning tool 416 is held in a holder 417, which in the example of FIG. 2 is stationarily arranged on the housing of the first dressing spindle 410.

Thus, in the context of the present invention, the dressing device 400 performs the function of a combined dressing and conditioning device. Strictly speaking, only the first dressing spindle 410 with the dressing tool 415 clamped thereon forms the actual dressing device, while the second dressing spindle 420 with the conditioning tool 425 clamped thereon and the holder 417 with the stationary conditioning tool 416 form a conditioning device.

Using NC axes to generate movements with respect to X1, Y1, Z1, A1, X_P, Y_P, C_P1, and C_P2, the grinding tool 320 can be selectively brought into engagement with each of the three dressing or conditioning tools 415, 416, and 425.

Grinding Tool in the Form of a Profile Grinding Wheel

Figure 3:
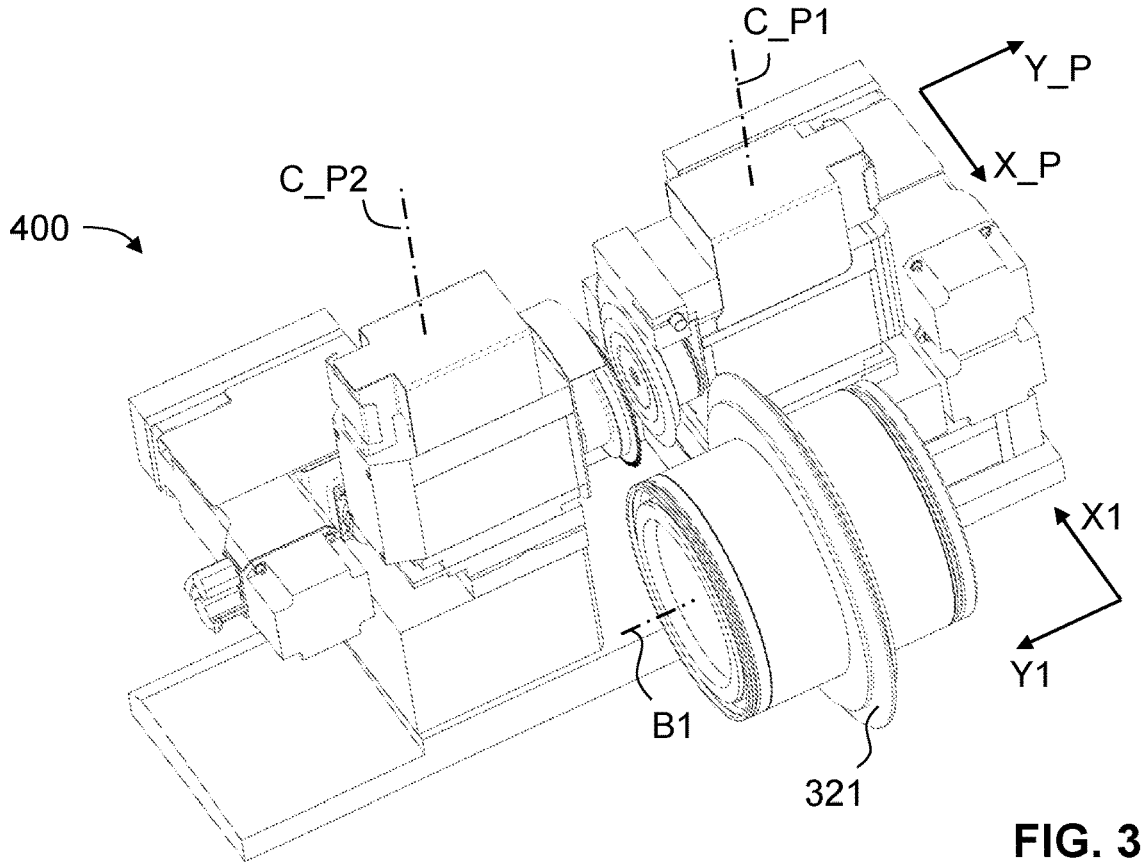
FIG. 3 shows the section of FIG. 2, wherein a profile grinding wheel is provided as the grinding tool instead of a grinding worm.

While the grinding tool 320 in FIG. 2 is a grinding worm, FIG. 3 illustrates the use of a grinding tool 321 in the form of a profile grinding wheel. All the considerations described here also apply mutatis mutandis to this type of grinding tool. When profile grinding wheels are used, the term "tangential feed direction" is usually used for the direction Y1 instead of the term "shift direction".

Dressing and Conditioning Process

To dress the grinding tool 320 or 321, the rotating grinding tool 320, 321 is first brought into engagement with the dressing tool 415, which is also rotating. This produces or restores the desired outer contour of the grinding tool 320, 321 and the grinding tool 320, 321 is sharpened.

In order to avoid or at least reduce the undesirable grinding-in behavior of the grinding tool 320, 321 dressed in this way, as described above, the rotating grinding tool 320, 321 is then brought into engagement with the rotating conditioning tool 425 and/or with the stationary conditioning tool 416. Conditioning is carried out until it is ensured that no thermal damage occurs to the edge zone of the workpieces during subsequent workpiece machining, even if machining is carried out with the same technological parameters for all workpieces.

Dressing and Conditioning Tools

Instead of a dressing tool and a conditioning tool of the type shown in FIGS. 1 to 3, other types of dressing and conditioning tools may be used. Accordingly, the dressing and conditioning device may be configured differently.

The dressing tool 415 may be any dressing tool suitable for dressing an abrasive body made of vitrified-bonded cBN. Such dressing tools are known in the prior art in a variety of embodiments. They can be used for dressing in various ways.

For example, it is known that the dressing of a grinding worm can be performed in line contact between the dressing tool and the grinding tool in order to map the profile of the dressing tool onto the profile of the grinding tool. This is referred to as "profile dressing". If the dressing tool rotates, it is referred to as a "profile roll". Depending on the dressing tool and dressing device, each flank of a worm start can be dressed individually during profile dressing, both flanks of a worm start can be dressed simultaneously, or the flanks of two or more worm starts of a multi-start grinding worm can be dressed simultaneously. In addition to the flanks, it is also possible to dress the head and/or foot areas of the worm starts simultaneously or successively. The same dressing tool or another dressing tool can be used for this purpose (cf. e.g. U.S. Pat. No. 6,234,880B1).

It is also known to dress a grinding worm in point contact, whereby the dressing tool is then guided line by line along the flanks of the grinding worm. This is referred to as "form dressing". If the dressing tool rotates, it is referred to as a "form roll".

Mixed forms are also known, in which parts of the profile are dressed in line contact and other parts in point contact, either with different dressing tools or with different areas of the same dressing tool (see e.g. U.S. Pat. No. 6,012,972A).

Accordingly, there are a large number of designs of dressing tools. For example, disc-shaped dressing tools (dressing rolls) are known which are driven to rotate about a dressing tool axis for dressing, as is the case with the dressing tool 415. The dressing tool then often has a disc-shaped base body made of steel on which an abrasive coating, for example of diamond grains, is applied. Other types of dressing tools, on the other hand, are configured to be stationary. Such dressing tools may also have a base body of steel which is coated with abrasive material.

Different types of dressing methods and corresponding dressing tools are also known for dressing profile grinding wheels. In particular, a profile grinding wheel can also be dressed in line contact or in point contact. This can again be done with a rotating, disc-shaped dressing tool of the type of dressing tool 415 or with a stationary dressing tool, wherein the dressing tool may have a base body made of steel and an abrasive coating.

An equally large variety of configurations is possible for the conditioning process and the conditioning tool used for this purpose. The conditioning of the grinding tool can also be carried out in line contact or in point contact. The conditioning tool may be configured to be rotating or stationary. In particular, it may be formed by the steel base body of a dressing tool in which the abrasive coating has been omitted, so that the grinding tool is conditioned directly with the steel of the base body.

The conditioning tool may be of the same type as the dressing tool. For example, both the dressing tool and the conditioning tool may be a disc-shaped tool that is rotated during dressing or conditioning. However, the conditioning tool may also be different from the dressing tool. For example, the dressing tool may be rotating while the conditioning tool is stationary.

The decisive factor is that conditioning is not performed with a sacrificial workpiece that is clamped on the workpiece spindle for conditioning, but with a separate conditioning tool. The conditioning tool is not clamped on the workpiece spindle, and conditioning is not performed with a kinematics that correspond to the kinematics used in workpiece machining, but rather conditioning is performed with a kinematics that correspond to the kinematics of a typical dressing operation. While the kinematics used in conditioning may be different from the actual kinematics used in dressing (e.g., because the dressing tool and the conditioning tool are not the same), it is nonetheless a kinematics such as might be used in dressing.

In the examples of FIGS. 1 to 3, the same movement axes can be used for conditioning that can also be used for dressing. These include the axes X_P, Y_P, C_P1 and/or C_P2. These axes are purely dressing and conditioning axes that are not relevant for workpiece machining. The movement sequences during conditioning in the examples of FIGS. 1 to 3 are therefore obviously completely different from those during workpiece machining.

Workpiece Machining

After conditioning, the machining of workpieces takes place. For the sake of completeness, this is illustrated in FIG. 4 for the example of continuous generating gear grinding and in FIG. 5 for the example of discontinuous profile grinding.

Figure 4:
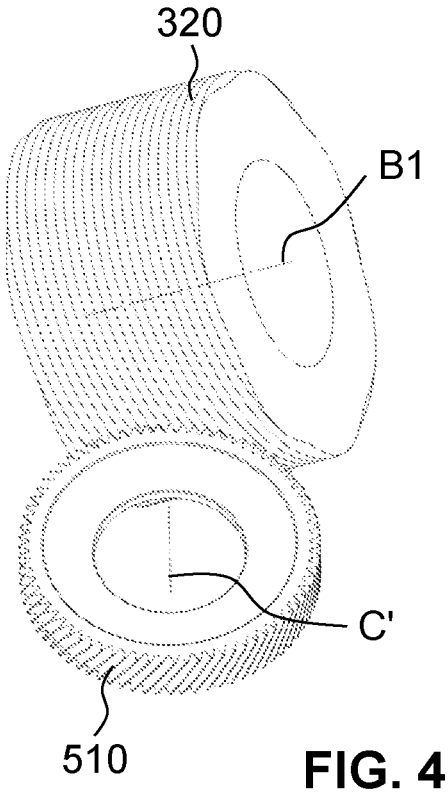
FIG. 4 shows a sketch showing a grinding worm in engagement with a workpiece.

In the example of FIG. 4, the grinding tool 320 is a grinding worm that is in rolling engagement with the workpiece 510. At the same time, the workpiece 510 rotates about the workpiece spindle axis C' at a rotation speed that has a predetermined rotation speed ratio to the rotation speed of the grinding tool 320. This rolling engagement is established electronically by the machine control 600. The grinding tool 320 is simultaneously advanced continuously along the feed direction Z1 over the entire width of the workpiece and, if necessary, shifted along the shift direction Y1. It is apparent that this kinematics is significantly different from the kinematics used in dressing and conditioning.

Figure 5:
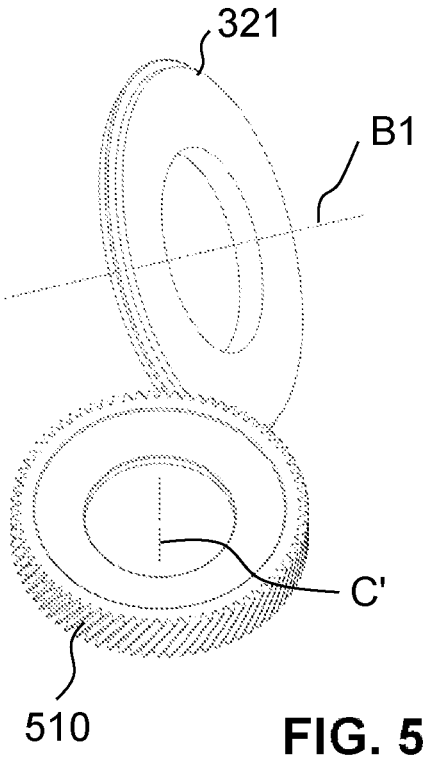
FIG. 5 shows a sketch showing a profile grinding wheel in engagement with a workpiece.

In the example of FIG. 5, the grinding tool 321 is a profile grinding wheel. The rotating grinding tool 321 is sequentially inserted into each tooth gap of the workpiece 510 to machine the same. During the machining of a tooth gap, the workpiece 510 is stationary and the grinding tool 321 is continuously advanced along the feed direction Z1 over the entire width of the workpiece. Subsequently, the workpiece is rotated for machining the next tooth gap. It is obvious that this kinematics also differs significantly from the kinematics during dressing and conditioning.

Flowchart

Figure 6:
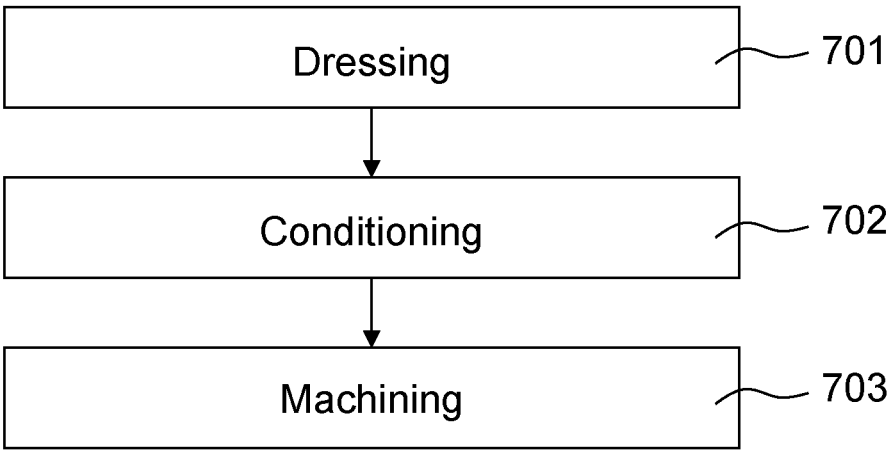
FIG. 6 shows a flow chart for a method according to the present invention.

The method described above is summarized in the form of a flow chart in FIG. 6. In step 701, the grinding tool is dressed. In step 702 it is conditioned. Then, in step 703, workpieces are machined. When the grinding tool is worn to the extent that it needs to be reprofiled and/or resharpened, steps 701 and 702 are carried out again.

Other Variations

The invention is not limited to the above embodiments, and further variations are possible. In particular, the invention is not limited to any particular machine design, but can be used with any gear grinding machine that allows both dressing and conditioning.

LIST OF REFERENCE SIGNS

100 machine bed
200 tool carrier
210 infeed slide
220 feed slide
300 tool head
310 tool spindle
320, 321 grinding tool
400 dressing device
410 dressing spindle
411 pivot drive
412 linear drive
415 dressing tool
416 conditioning tool
417 holder
420 dressing spindle
421 pivot drive
425 conditioning tool
500 workpiece spindle
510 workpiece
600 machine control
701-703 procedural steps
X, Y, Z coordinates
X1 infeed direction
Y1 shift direction
Z1 axial feed direction
A1 pivot axis of tool head
C1 pivot axis of tool carrier
C' workpiece spindle axis
X_P, Y_P displacement directions dressing/conditioning
C_P1, C_P2 pivot axes dressing/conditioning

The invention claimed is:

1. A method for machining pre-toothed workpieces in a gear grinding machine using a grinding tool, comprising the steps of:

a) dressing the grinding tool using a dressing tool, wherein the gear grinding machine executes a dressing kinematics for moving the dressing tool relative to the grinding tool during the dressing of the grinding tool, wherein the grinding tool comprises vitrified-bonded abrasive grains made of a superabrasive material having a Vickers microhardness at room temperature that is higher than for corundum, wherein a geometric shape of the grinding tool is produced or restored by the dressing of the grinding tool;

b) conditioning the dressed grinding tool using a conditioning tool, wherein the geometric shape of the dressed grinding tool is not changed by the conditioning of the grinding tool, wherein the gear grinding machine executes a conditioning kinematics for moving the conditioning tool relative to the dressed grinding tool during the conditioning of the dressed grinding tool; and c) machining the pre-toothed workpieces using the dressed and conditioned grinding tool, wherein the gear grinding machine executes a machining kinematics for moving the dressed and conditioned grinding tool relative to the pre-toothed workpieces during the machining of the pre-toothed workpieces, wherein the conditioning kinematics is different from the machining kinematics.

2. The method of claim 1, wherein the conditioning kinematics corresponds to the dressing kinematics.

3. The method of claim 1, wherein the gear grinding machine comprises a dressing spindle on which the dressing tool is clamped in step a);

wherein the gear grinding machine comprises a conditioning spindle on which the conditioning tool is clamped in step b), wherein the gear grinding machine comprises a workpiece spindle on which the workpieces are clamped in step c), and wherein the conditioning spindle is different from the dressing spindle and from the workpiece spindle.

4. The method of claim 3, wherein the conditioning tool has a basic shape that is different from a basic shape of the workpieces.

5. The method of claim 4, wherein the basic shape of the conditioning tool corresponds to a basic shape of the dressing tool.

6. The method of claim 1, wherein during the conditioning the grinding tool is in direct contact with a metallic portion of the conditioning tool.

7. The method of claim 6, wherein the metallic portion of the conditioning tool that is in direct contact with the grinding tool during the conditioning is made of steel.

8. The method of claim 1, wherein the grinding tool rotates during the step of conditioning and the conditioning tool is stationary during the step of conditioning.

9. The method of claim 1, wherein the grinding tool rotates during the step of conditioning and the conditioning tool rotates during the step of conditioning.

10. The method of claim 1, wherein the conditioning tool is in line contact with the grinding tool during the step of conditioning.

11. The method of claim 1, wherein the conditioning kinematics comprises a relative movement between the grinding tool and the conditioning tool such that a contact position between the conditioning tool and the grinding tool changes along a profile of the grinding tool during conditioning.

12. The method of claim 1, wherein the step b) of conditioning is carried out several times with the same conditioning tool.

13. The method of claim 1, wherein the grinding tool is a grinding worm.

14. The method of claim 1, wherein the conditioning tool corresponds to a metallic base body of a dressing roll, the conditioning tool being devoid of any hard material coating in a region that is in direct contact with the grinding tool during the conditioning.

15. The method of claim 1, wherein the conditioning tool is in point contact with the grinding tool during the step of conditioning.

16. The method of claim 1, wherein the grinding tool is a profile grinding wheel.

17. The method of claim 1, wherein the conditioning comprises removing a bonding agent between the abrasive grains of the grinding wheel to partially expose the abrasive grains.

18. The method of claim 1, wherein the superabrasive material is cubic boron nitride.

19. A method for machining pre-toothed workpieces in a gear grinding machine using a grinding tool, comprising the steps of:

a) dressing the grinding tool using a dressing tool, wherein the gear grinding machine executes a dressing kinematics for moving the dressing tool relative to the grinding tool during the dressing of the grinding tool, wherein the grinding tool comprises vitrified-bonded abrasive grains made of a superabrasive material;

b) conditioning the dressed grinding tool using a conditioning tool such that a desired wear condition of the grinding tool is produced, wherein the gear grinding machine executes a conditioning kinematics for moving the conditioning tool relative to the dressed grinding tool during the conditioning of the dressed grinding tool; and c) machining the pre-toothed workpieces using the dressed and conditioned grinding tool, wherein the gear grinding machine executes a machining kinematics for moving the dressed and conditioned grinding tool relative to the pre-toothed workpieces during the machining of the pre-toothed workpieces, wherein the conditioning kinematics is different from the machining kinematics, wherein all workpieces in step c) are machined with identical machining parameters, wherein the machining parameters are selected such that thermal edge zone damage would occur during machining of at least a first workpiece in step c) if step b) were not performed, and wherein in step b) the conditioning is carried out in such a way that no thermal edge zone damage occurs during the machining in step c).

20. A gear grinding machine, comprising:

a tool spindle;

at least one workpiece spindle;

a dressing spindle;

a conditioning spindle;

a plurality of machine axes for driving the tool spindle, the workpiece spindle, the dressing spindle, and the conditioning spindle, and for moving the tool spindle, the workpiece spindle, the dressing spindle, and the conditioning spindle relative to each other; and a control unit for controlling the machine axes, the control unit being configured to control the machine axes such that the machine tool performs a method comprising:

a) dressing a grinding tool while the grinding tool is clamped on the tool spindle, the dressing being carried out with a dressing tool that is clamped on the dressing spindle, wherein a geometric shape of the grinding tool is produced or restored by the dressing of the grinding tool, wherein the gear grinding machine executes a dressing kinematics for moving the dressing tool relative to the grinding tool during the dressing of the grinding tool;

b) conditioning the dressed grinding tool while the dressed grinding tool is clamped on the tool spindle, using a conditioning tool clamped on the conditioning spindle, wherein the geometric shape of the dressed grinding tool is not changed by the conditioning of the dressed grinding tool, and wherein the gear grinding machine executes a conditioning kinematics for moving the conditioning tool relative to the dressed grinding tool during the conditioning of the dressed grinding tool; and c) machining pre-toothed workpieces clamped on the at least one workpiece spindle using the dressed and conditioned grinding tool while the dressed and conditioned grinding tool is clamped on the tool spindle, wherein the gear grinding machine executes a machining kinematics for moving the dressed and conditioned grinding tool relative to the pre-toothed workpieces during the machining of the pre-toothed workpieces, wherein the conditioning kinematics is different from the machining kinematics.

* * * * *